United States Patent [19]

Goncalves

[11] 3,968,914

[45] July 13, 1976

[54] CONTAINER ASSEMBLY

[75] Inventor: Antonin Goncalves, Groslay, France

[73] Assignee: Societe Anonyme dite: L'Oreal, Paris, France

[22] Filed: Dec. 16, 1974

[21] Appl. No.: 533,213

[30] Foreign Application Priority Data

Feb. 26, 1974 France ..... 74.06432

[52] U.S. Cl. ..... 224/45 AA; 294/87.2

[51] Int. Cl.[2] ..... B65D 71/00

[58] Field of Search ..... 224/45 AA; 294/87.2, 294/87 R, 87.28, 87.24; 206/199, 203, 427; 248/316; 220/352

[56] References Cited

UNITED STATES PATENTS

| | | | |
|---|---|---|---|
| 2,740,657 | 4/1956 | Poupitch | 294/87.2 |
| 2,896,779 | 7/1959 | Armel | 294/87.2 |
| 2,936,070 | 5/1960 | Poupitch | 294/87.2 |
| 2,996,329 | 8/1961 | Glazer | 294/87.2 |
| 3,003,805 | 10/1961 | Glazer | 294/87.2 |
| 3,036,853 | 5/1962 | Glazer | 294/87.2 |
| 3,633,962 | 1/1972 | Erickson | 294/87.2 |
| 3,653,624 | 4/1972 | Abel | 224/45 AA |

*Primary Examiner*—Frank E. Werner
*Assistant Examiner*—Kenneth Noland
*Attorney, Agent, or Firm*—Brisebois & Kruger

[57] ABSTRACT

Container assembly comprises a plurality of containers having similar externally ridged caps and a carrier bar provided with holes bordered by internally ridged sleeves which are a force fit onto said caps.

12 Claims, 6 Drawing Figures

CONTAINER ASSEMBLY

SUMMARY OF THE INVENTION

It is well known that one of the problems to be solved in the distribution and sale of products stored in containers such as bottles and jars is that of inexpensively fastening together a certain number of these containers so as to permit their convenient transportation from the place of manufacture to the point of distribution and sale.

For this purpose recourse is often had to cartons which contain a certain number of containers or to wrappers of a plastic material which encircle a group of containers over the greater part of its periphery. It has also been suggested that the containers be located on a base plate comprising lateral grooves which engage in a rib provided on the base of each of the containers to be grouped together. This latter technique, however, requires the use of containers having relatively rigid walls and a base section which is substantially circular.

It is the object of the present invention to describe a new method of joining together a group of containers, such as plastic bottles for example, which makes it possible to connect the group of containers by using very inexpensive means, which means are easily removable to release the containers from the group, and the use of which does not require any particular shaping of the containers or any particular rigidity of the walls thereof.

It is a further object of the invention to provide as a new article of manufacture a group of containers such as bottles for example, each of which is provided with a cap covering the upper part of the neck of the bottle, said cap having a substantially cylindrical or slightly frusto-conical lateral surface, with the smaller end of the cone at the end of the cap remote from the bottle, said lateral surface being provided with striations extending side by side along the generatrices of the lateral surface. This group is characterized by the fact that all the caps of the bottles in the group are held together by a bar having therein as many openings as there are bottles. Each opening is laterally defined by a cylindrical or slightly frusto-conical sleeve, with the small end of the cone being then on the side of the bar remote from the bottle, said sleeve being internally provided with ribs parallel to the generatrices of its surface said ribs having a maximum size which is slightly greater than the width of the striations formed in the lateral surface of the corresponding cap and the depth of which measured perpendicularly to the surface of the sleeve is preferably slightly greater than the depth of the striations in the cap. The homothetic section of each sleeve defined by the summits of the ribs of the upper part of the sleeve has a form analogous to and dimensions slightly smaller than the largest transverse outer section of the cap, measured preferably at the bottom of the striations.

In a preferred embodiment, the containers of a single group have identical caps which are frusto-conical in shape, with a small angle of conicity and a circular section, and the sleeves of the bar are cylindrical surfaces having a circular section, all the ribs of which are identical. The lateral surface of each cap carries striations having a triangular profile, the depth of which lies between 0.1 and 0.3 mm while the thickness of the ribs measured perpendicularly to the surface of the sleeve lies between 0.3 and 0.6 mm. The maximum width of the striations of the cap lies between 0.3 mm and 0.6 mm and the maximum width of the ribs of the bar lies between 0.6 mm and 1.2 mm. The number of striations on the cap is dependent on the weight of each container, when filled, and preferably lies between 5 and 20 times the number of ribs on the sleeve. The lower part of the sleeve has a chamfer facilitating the introduction of a cap into the sleeve. The diameter of the circular section passing through the apices of the ribs of the sleeve lies between the diameter of the circular section at the tips of the ribs separating two adjacent striations on the cap measured at the extreme upper end of the plug and the analogous diameter measured at the extreme lower end of the cap. The height of the sleeves of a bar lies between 0.15 and 0.80 times, and preferably between 0.25 and 0.50 times, the height of the caps of the containers to be fastened together. The bar comprises identical sleeves, the axes of which are positioned parallel to each other in the same plane. The sleeves are held together at one of their ends by a plate encircled by a rim, the height of which is at least equal to the height of the sleeves, said rim being positioned on the same side of the plate as the sleeves. The ribs on the sleeves extend from the zone adjacent the plate up to a point spaced between 0.1 and 0.4 times the height of the sleeve from the chamfer.

It has unexpectedly been found that the bar according to the invention makes it possible to fasten the containers together and permit them to be transported even in the case of relatively heavy containers. In effect, when the bar according to the invention is positioned on the group of caps of the containers to be held together, because of the dimensions adopted, the ribs of the sleeve are jammed into the striations of the cap. Consequently, the bar grips the caps so tightly as to permit the containers to be carried when the user holds only the bar, even though the bar may be easily removed by hand when the ability of the bar to slide on the cap is selectively chosen. It is clear that, under these conditions, a particularly advantageous embodiment of the device according to the invention results from the manufacture of the caps of the container and the bar from a plastic material. Good results from this point of view have been obtained by using caps of polypropolene and bars of high impact polystyrene. The bar is mounted on the containers of a group manually but may also be mounted automatically by means of a machine which, in a first step, positions all the containers in a group, and, in a second step, locates the bar on the caps and depresses the bar with a predetermined pressure. In such a method of operation the force to be applied to the bar is such that the sleeves are forced tightly enough down on the caps to permit transportation of the containers by means of the bar, but not tightly enough to prevent the user from manually separating the container from the bar by pressing on the cap of the container.

It is clear that the device according to the invention is particularly valuable because of its low cost, and the fact that the containers may be fastened together by an automatic machine by means of a bar of molded plastic material which is extremely inexpensive.

In order that the object of the invention may be better understood, one embodiment thereof will now be described, purely by way of illustration and example, with reference to the accompanying drawings, on which:

Figure 1:
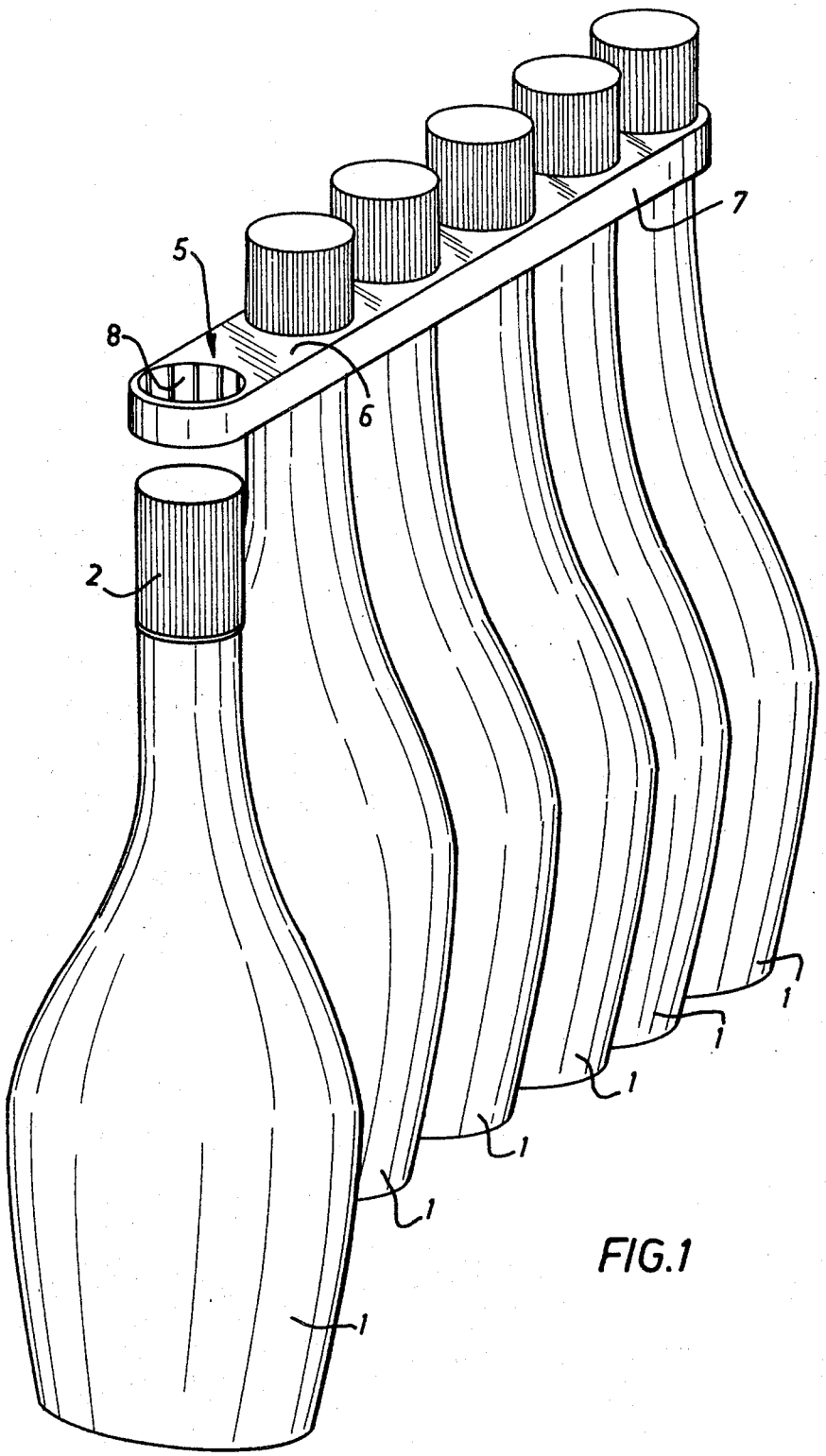
FIG. 1 is a perspective view showing the group of containers according to the invention, one of the containers being separated from the carrying bar.
Figure 3:
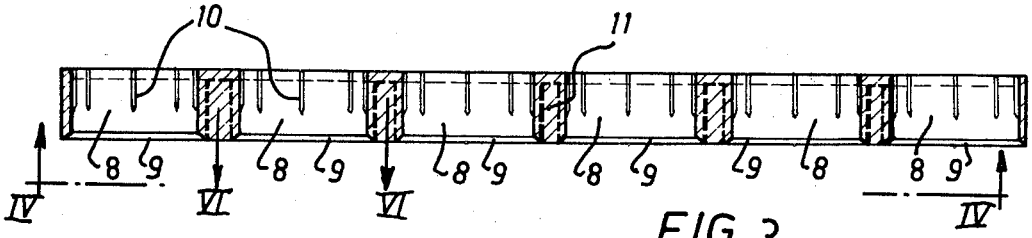
FIG. 3 is a sectional view taken along the line III—III of FIG. 2.
Figure 2:
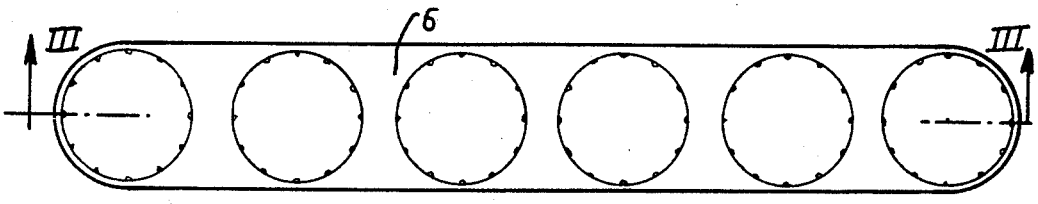
FIG. 2 is a plan view of the carrying bar of FIG. 1.
Figure 4:
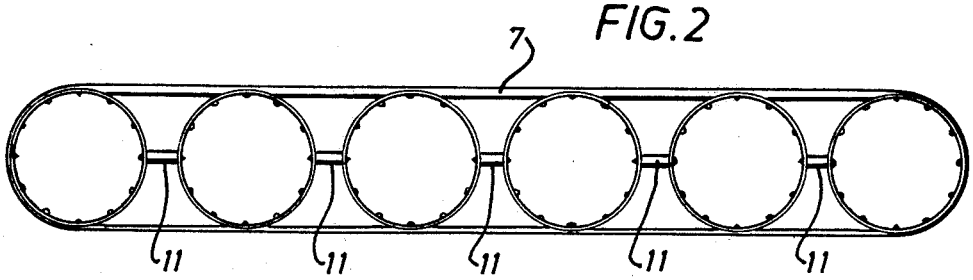
FIG. 4 is a view taken along the line IV—IV of FIG. 3 looking upwards.
Figure 6:
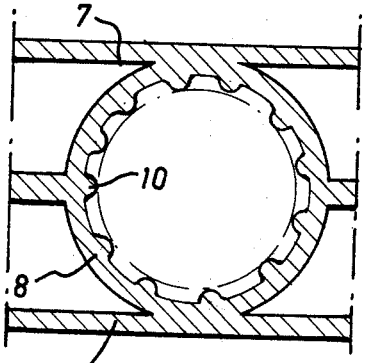
FIG. 6 is a detail view on a larger scale showing a section taken along the line VI—VI of FIG. 3.
Figure 5:
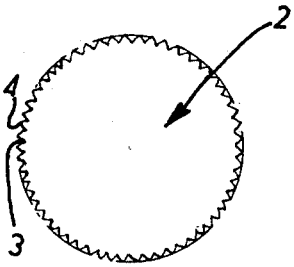
FIG. 5 is a top plan view of the cap of a container of the group of FIG. 1.

Referring now to the drawings, it will be seen that reference numeral 1 indicates the bottles which are to be fastened together, each of these bottles being made of a plastic material and having a threaded neck carrying a cap 2. The cap 2 is made of molded polypropolene. It has on its lateral surface 160 striations having a triangular section, the depth of these striations being 0.2 mm. The diameter of the striated cap at the apices of the ribs 3 which separate two successive striations 4 is equal to 29.2 mm at the top of the cap and 30 mm at the bottom of the cap. The cap 2 is thus frusto-conical and the striations 4 are disposed along the generatrices of this frusto-conical cap. The cap is 34 mm high.

Reference numeral 5 indicates the bar for carrying the group according to the invention, considered as a whole. The bar 5 is made of a molded high impact polystyrene. It comprises a flat plane 6 having an elongated shape, the major axis of which is straight, the plate 6 being rounded at its two ends. The plate 6 is encircled by a rim 7 which is 12 mm in height and comprises 6 orifices having a diameter of 29.4 mm. In alignment with each of the orifices are the cylindrical sleeves 8 which are connected to the plate 6 and are located on the same side of this plate as the rim 7. The height of the sleeves 8 is equal to the height of the rim 7. At the bottom of each sleeve 8 is a chamfer 9. Each sleeve 8 comprises 12 internal ribs 10 which project from the inner wall of the sleeve. The ribs 10 have a semi-circular section with the radius of the semi-circle lying between 0.3 and 0.6 mm. The ribs 10 extend from the end of the sleeve remote from the chamfer 9 for a distance of 9 mm. The six sleeves 8 of the bar 5 have their axes parallel and lying in the longitudinal median plane of the bar, and are connected to each other by crossbars lying in this same longitudinal median plane. In the zones in which the sleeves 8 become tangent to the rim 7, the wall of the rim 7 and the wall of the sleeve 8 merge. The thickness of the walls of the sleeves is about 1.5 mm.

When six containers 1 are to be fastened together, these containers are positioned side by side parallel to each other with the axes of the containers in alignment. The bar 5 is then positioned above the caps 2 and pressed down by means of a press, or manually, so as to lower the bar 5 on the caps. This depression is facilitated by the presence of the chamfers 9 which facilitate the penetration of the upper part of the caps into the sleeves 8. This depression is also assisted by the fact that the ribs 10 do not extend downwardly as far as the chamfer 9. When the caps have been engaged in the sleeves 8 the depression of the bar on the caps becomes more and more difficult because the ribs 10 are squeezed into the striations 4 of the caps, which squeezing results not only from the reduction in diameter due to the slight conicity of the cap, but also from the section of the ribs 10 which is greater than that of the striations 4 thereopposite. This results in a deformation of the striations and ribs in contact with each other. In other words, the gripping of caps 2 by the bar results on the one hand from the conicity of the caps and on the other hand from the cooperation between the ribs 10 and the striations 4. It has been found that, with the dimensions which have been hereinbefore indicated, a bar associated with six containers weighing about 340 grams each will support these six containers perfectly when pressed down on the caps with a force of about 50 kg. Under these circumstances, it is possible to carry the group of containers by holding only the bar in the hand and, on the other hand, to extract a container 1 from the group by manually depressing the top of the cap 2 of that container. It will, of course, be appreciated that the embodiment which has just been described has been given purely by way of illustration and may be modified as to detail without thereby departing from the basic principles of the invention as defined by the following claims.

What is claimed is:

1. In a container assembly comprising in combination a plurality of containers provided with substantially identical caps and a carrier bar defining a corresponding number of openings completely encircled by sleeves, the improvement according to which said caps have a circular transverse cross section and an external cylindrical surface, each said cylindrical surface carrying a plurality of ridges extending outward of said surface and in the direction of said cylinder, and said sleeves have closed internal surfaces of revolution mating approximately with said cylindrical external surface, but provided with a different number of ridges having different dimensions which interengage with the ridges on said caps, said caps and sleeves being made of a resilient material so that said ridges are compressible and the maximum undistended inner diameter of said sleeves being slightly less than the maximum uncompressed outer diameter of said caps, so that when said caps are forced into said sleeve said ridges are compressed and the caps are frictionally retained in said sleeves said caps having an axial length greater than said sleeves.

2. Assembly as claimed in claim 1 in which the external surfaces of said caps are frusto-conical, with a small angle of conicity and a circular section, the sleeves of the bar having cylindrical inner surfaces having a circular section and all of the ridges on said sleeves being identical.

3. Assembly as claimed in claim 2 in which the diameter of the circular section passing through the summits of the ridges on each sleeve lies between the diameter of the circular section passing through the summits of the ridges separating two adjacent striations on the cap measured at the larger end of the cap and the analogous diameter measured at the smaller end of the cap.

4. Assembly as claimed in claim 1 in which the outer surface of each cap carries striations having a triangular profile, the depth of which lies between 0.1 and 0.3 mm, the width of the ridges between said striations, measured perpendicularly to the surface of the sleeve, lying between 0.3 and 0.6 mm.

5. Assembly as claimed in claim 4 in which the maximum width of the striations of the cap lies between 0.3 mm and 0.6 mm and the maximum width of the ridges of the bar lies between 0.6 mm and 1.2 mm.

6. Assembly as claimed in claim 1 in which the number of striations on the cap lies between 5 and 20 times the number of ridges on the sleeve.

7. Assembly as claimed in claim 1 in which the one end of each sleeve is provided with a chamfer facilitating the introduction of the cap into the sleeve.

8. Assembly as claimed in claim 7 in which the ridges on each sleeve terminate at a distance of from 0.1 and 0.4 times the axial length of the sleeve, said distance being measured from its chamfer.

9. Assembly as claimed in claim 1 in which the axial length of the sleeves of the bar lies between 0.15 and 0.80 times the axial length of the caps of the containers.

10. Assembly as claimed in claim 1 in which the axial length of the sleeves of the bar lies between 0.25 and 0.50 times the axial length of the caps of the containers.

11. Assembly as claimed in claim 1 in which the axes of said sleeves lie parallel to each other in the same plane, said sleeves being connected together at one end by a plate encircled by a rim the height of which is at least equal to the axial length of the sleeves, said rim being positioned on the same side of the plate as the sleeves.

12. Assembly as claimed in claim 1 in which the caps of the containers of the group are made of polypropolene and the bar is made of high impact polystyrene.

* * * * *